US006296528B1

(12) United States Patent
Roberts et al.

(10) Patent No.: US 6,296,528 B1
(45) Date of Patent: Oct. 2, 2001

(54) JACK WITH FEATURE FOR SELECTIVELY RESTRICTING PLUG INSERTION

(75) Inventors: James T. Roberts, Oak Park; Yan Margulis, Buffalo Grove, both of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/564,111

(22) Filed: May 3, 2000

(51) Int. Cl.[7] ..... H01R 24/00
(52) U.S. Cl. ..... 439/676; 439/677
(58) Field of Search ..... 439/676, 344, 439/345, 677

(56) References Cited

U.S. PATENT DOCUMENTS

| | | | | |
|---|---|---|---|---|
| 4,350,409 | | 9/1982 | Kato et al. . | |
| 4,376,565 | | 3/1983 | Bird et al. . | |
| 4,448,467 | | 5/1984 | Weidler . | |
| 4,764,129 | * | 8/1988 | Jones et al. | 439/677 |
| 5,244,402 | | 9/1993 | Pasterchick et al. | 439/217 |
| 5,342,221 | | 8/1994 | Peterson | 439/677 |
| 6,168,473 | * | 1/2001 | Hsin | 438/676 |
| 6,186,835 | * | 2/2001 | Cheshire | 439/676 |

* cited by examiner

*Primary Examiner*—Brian Sircus
*Assistant Examiner*—Hae Moon Hyeon
(74) *Attorney, Agent, or Firm*—Stephen Z. Weiss

(57) ABSTRACT

A modular jack includes a substantially rectangular dielectric receptacle housing having a front face, a bottom board mounting wall, and a top, rear and a pair of side walls substantially surrounding a plug-receiving cavity. The cavity extends rearwardly from the front face for receiving a mating plug connector. In order to limit insertion of an undersized plug into a full-sized plug-receiving cavity in the receptacle housing, a stop surface is incorporated into a flexible stop member projecting from the housing and extending into the plug-receiving cavity. The stop surface is located within the cavity so as to ensure contact with a leading edge of an undersized plug upon insertion of the undersized plug into the cavity. A sliding surface is also incorporated into the flexible member. The sliding surface is located within the cavity so as to ensure contact with a leading edge of a plug upon insertion into the cavity of a mating plug having a width appropriate for mating with the jack. The sliding surface resides closer to the front face of the receptacle housing than does the stop surface. When an undersized plug is inserted into the cavity, the leading edge of the undersized plug contacts the stop surface, preventing full insertion of the undersized plug into the cavity. When a mating plug is inserted into the cavity, the leading edge of the mating plug contacts the more forwardly-positioned sliding surface before reaching the stop surface. Sliding contact between the sliding surface and the mating plug leading edge causes the sliding surface to move. This movement produces a corresponding movement in the flexible stop member and the stop surface incorporated thereon such that the stop surface is located out of engagement with the leading surface of the mating plug, permitting full insertion of the mating plug into the cavity.

8 Claims, 6 Drawing Sheets

JACK WITH FEATURE FOR SELECTIVELY RESTRICTING PLUG INSERTION

FIELD OF THE INVENTION

This invention generally relates to the art of electrical connectors and, particularly, to a structure for selectively limiting insertion of a plug into a plug-receiving cavity in a receptacle connector housing.

BACKGROUND OF THE INVENTION

Jacks define female receptacle connectors having a nonconductive housing and electrical conductive terminals therein. The jack typically is mounted to a circuit board, panel or the like, with the terminals in the jack being electrically connected to conductive areas on the circuit board or to a cable. The jack is mateable with a male plug connector which also has a nonconductive housing and a corresponding number of electrically conductive terminals. The plug frequently will be attached to a cable having a plurality of electrically conductive leads which are respectively connected to the terminals in the plug. The cable leading to the plug may be a round cable or a flat flexible cable depending upon the particular application. This combination of jacks and mateable plugs, constituting a modular jack/plug (or mod-jack)assembly, is used in many electrical devices, with broad applications being found in the computer and telecommunications industries. Currently, 4, 6, and 8 circuit mod-jack assemblies are manufactured. 10 circuit assemblies may be developed in the future.

Mating between the plug and jack is generally effected by insertion of the plug into a plug-receiving cavity in the receptacle housing. Locating ribs may be provided on the body of the plug to aid in positioning of the plug with respect to the receptacle housing prior to and during plug insertion. A latching system may be provided for maintaining the plug and receptacle in a mated state once the plug has been inserted. As an indication to a user that the plug has been fully inserted into the jack, the latching system is generally configured to produce an audible clicking sound when the plug is fully inserted.

A problem exists with the current mod-jack assemblies in that undersized plugs, having a width smaller than that which a given plug-receiving cavity is designed to receive, can be inserted into a plug-receiving cavity of a receptacle housing. When an undersized plug is inserted into a plug-receiving cavity designed to receive a plug having a width greater than that of the undersized plug, the locating ribs on the plug body will align with terminals in the plug receiving cavity, damaging the terminals. Also, the connection between the larger-width jack and the smaller-width plug may be incompatible, even though the user hears an audible click indicating that the plug is fully inserted.

One method of addressing this problem is provided in Jones et al., U.S. Pat. No. 4,764,129. In Jones et al. '129, narrower plugs in a series of electrical connector assemblies are prevented from insertion into wider sockets in the series by varying the height of the plugs and sockets and/or varying the cross-sectional dimensions of a key and keyway provided on the plugs and sockets. A problem with this approach is that provision for numerous variations in the configurations of the plug and receptacle bodies greatly increases the complexity and expense of tooling, such as molds and assembly fixtures.

SUMMARY OF THE INVENTION

Therefore an object of the invention is to provide an improved apparatus and method for limiting the insertion of an undersized plug into a receptacle housing receiving cavity designed to receive a plug having a width larger than the width of the undersized plug.

In the one embodiment of the invention, the receptacle connector for selectively limiting insertion of an undersized plug into a plug receiving cavity includes a housing having a plug-receiving cavity with a polarizing slot for receiving one of either a first or second plug in a plug insertion direction. The first and second plugs each have a leading surface and a polarizing key. The polarizing key of each plug is adapted to be slidably inserted into the polarizing slot in the housing. The polarizing slot and the polarizing keys each have a center line. When either of the plugs is inserted into the plug receiving cavity, the center line of the plug polarizing key will be aligned with the center line of the polarizing slot of the plug receiving cavity. The leading surface of the first plug has a first plug dimension from the center line of the first plug polarizing key to an edge of the leading surface. The leading surface of the second plug has a second plug dimension from the center line of the second plug polarizing key to an edge, the second plug dimension of the leading surface being less than the first plug dimension.

A flexible stop member projects into the plug receiving cavity. The flexible member has a stop surface positioned within the plug-receiving cavity for contacting the leading surface of the second plug when the second plug is inserted into the plug-receiving cavity which will prevent further insertion of the second plug into the cavity. The stop surface is movable in response to insertion of the first plug into the plug-receiving cavity. The flexible member also has a sliding surface positioned within the plug receiving cavity. The sliding surface located a lateral distance from the centerline of the polarizing slot so as to contact the leading surface of the first plug as the first plug is inserted into the plug-receiving cavity. The distance between the center line of the plug polarizing key and the location on the plug leading surface contacted by the sliding surface during plug insertion is less than the first plug dimension and greater than the second plug dimension. Contact between the sliding surface of the flexible stop member and the plug leading surface will cause the flexible strip member to move so that the stop surface is located out of engagement with the leading surface of the first plug, allowing complete insertion of the first plug into the plug receiving cavity.

An additional embodiment includes a second flexible stop member which prevents both a second and third plug having, respectively, second and third plug dimensions between the centerline of the plug polarizing key and an edge of the plug leading surface which is less than the first plug dimension from being inserted into the plug receiving cavity. Finally, another embodiment includes a single flexible stop member with a stop surface adapted to contact the leading surface of either one of a second and third plug.

Other objects, features, and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
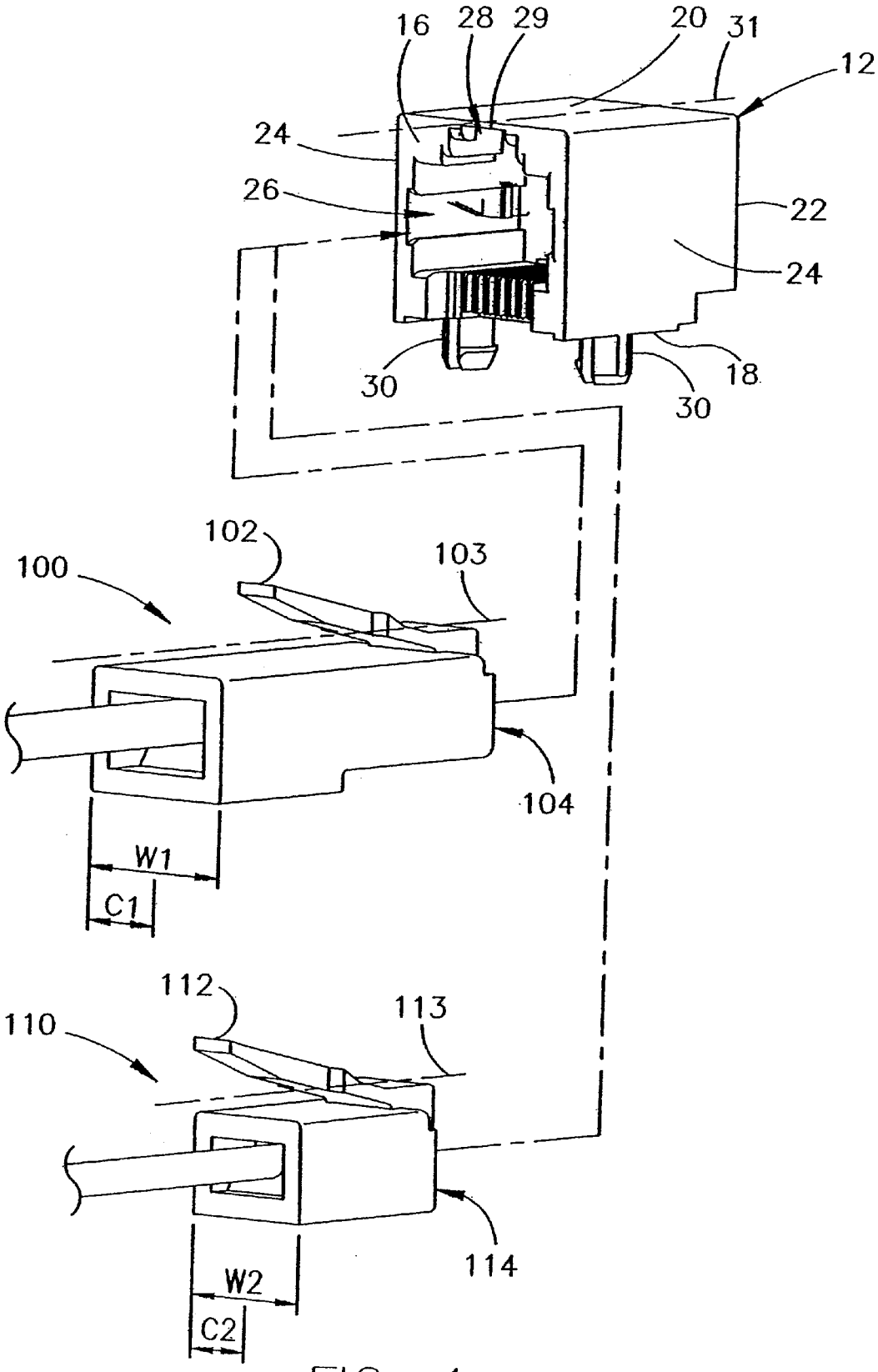
FIG. 1 is a front perspective view showing how the first and second plugs are inserted into the receptacle housing.

Referring to the drawings in greater detail, and first to FIG. 1, the invention is incorporated in a receptacle housing 12 for a jack, adapted for mounting to a circuit board (not shown) and for receiving a mating plug of standardized configuration. Receptacle housing 12 is substantially rectangular and is unitarily molded of dielectric material such as plastic or the like. A pair of bifurcated mounting posts 30 project from the housing for insertion into complementary mounting holes in the circuit board.

Receptacle housing 12 also includes a front face 16, a top wall 20, a bottom board mounting wall 18, a rear wall 22 and a pair of side walls 24 substantially surrounding a plug-receiving cavity, indicated generally at 26. The plug-receiving cavity 26 extends rearwardly from front face 16 for receiving a mating plug connector of standardized configuration.

A first plug connector, generally designated 100, includes a depending latch arm 102, which is also a polarizing key, projecting outwardly from one side thereof. The top of front face 16 of receptacle housing 12 has an opening 28 which communicates with cavity 26. This opening accommodates depending latch arm key 102 of first plug 100. The center line 103 of the latch arm key 102 is in line with the center line 31 of the polarizing slot 29. First plug 100 has a leading edge 104 which is inserted into cavity 26. First plug 100 also has a first dimension W1 along an axis perpendicular to the plug insertion direction. In a first embodiment, dimension W1 extends along a width of plug 100. First plug 100 is designed to be inserted into cavity 26 so as to mate with the jack. C1 is a dimension extending along the width of the plug from the center line 103 of the latch arm key 102 of the first plug 100 to one edge of the plug.

FIG. 1 also shows an undersized second plug 110 which may also be inserted into cavity 26. Second plug 110 has a leading edge 114 and a second dimension W2 along an axis perpendicular to the plug insertion direction. Depending latch key 112 has a center line 113 which is accommodated in polarization slot 29. The center line 113 is in line with center line 31 of polarizing slot 29. C2 is a dimension extending along width W2 from the center line 113 of the latch arm key 112 of second plug 110 to one edge of the second plug. As the first plug 100 is designed to be inserted into cavity 26 so as to mate with the jack while second plug 110 is undersized, the width of second plug 110 is less than the width of the first plug 100. Thus dimensions W2 and C2 are less than dimensions W1 and C1, respectively.

Figure 2:
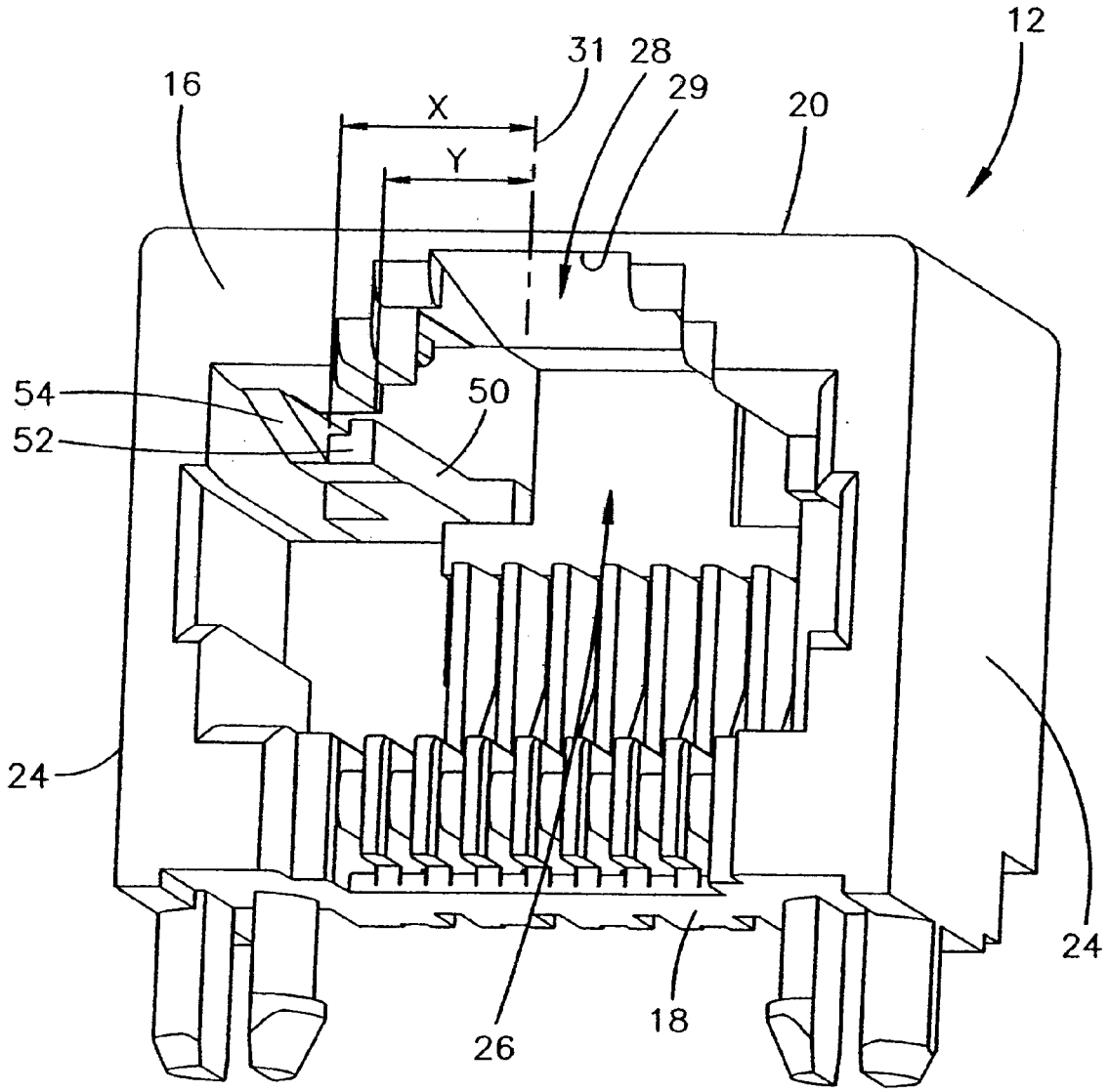
FIG. 2 is a front perspective view of the receptacle housing showing the locations of the stop surface and the sliding surface of the cantilevered flexible arm in relation to the centerline of the polarizing slot.

In order to limit the insertion of undersized second plug 110 into plug-receiving cavity 26 while allowing full insertion of first plug 100, a first stop surface 52 is movably positioned within cavity 26 for contacting leading edge 114 of second plug 110 in response to insertion of second plug 110 into the plug-receiving cavity. As shown in FIG. 2, the first embodiment locates the first stop surface 52 in the plug-receiving cavity by being a part of a first flexible member projecting from receptacle housing 12. The first flexible member comprises a first cantilever arm 50 projecting from rear wall 22 into cavity 26. First cantilever arm 50 may be formed integral with receptacle housing 12, or arm 50 may be a discrete component mounted in the receptacle housing 12 during fabrication. In addition, rather than residing within cavity 26, the stop surface 52 and sliding surface 54 of the first cantilever arm 50 may be located on a wall recessed within the terminal receiving cavity 26 below top wall 20. The cantilevered arm 50 may be formed from either a dielectric material or from metal. Also the receptacle housing 12 can be configured so that the polarizing slot 29 and the cantilevered arm 50 are located in the bottom of the housing rather than in the top as shown in the figures.

As seen in FIG. 2, first cantilever arm 50 also incorporates a first sliding surface 54 positioned within cavity 26. First sliding surface 54 is located at the free end of first cantilever arm 50 and forms an acute angle with respect to first plug leading edge 104 during plug insertion. First stop surface 52 is positioned intermediate the base of first cantilever arm 50 and first sliding surface 54. Thus, first sliding surface 54 resides closer than first stop surface 52 to front face 16 of receptacle housing 12. In addition, referring to FIG. 2, first sliding surface 54 is located at a beginning distance X from a centerline 31 of the polarizing slot 29 of the receptacle housing 12, and extends to a predetermined distance beyond distance X. The first stop surface 52 is located at a beginning distance Y from the centerline 31 and extends no further than distance X from the center line 31. The distance Y is less than the distance X.

Figure 3A:
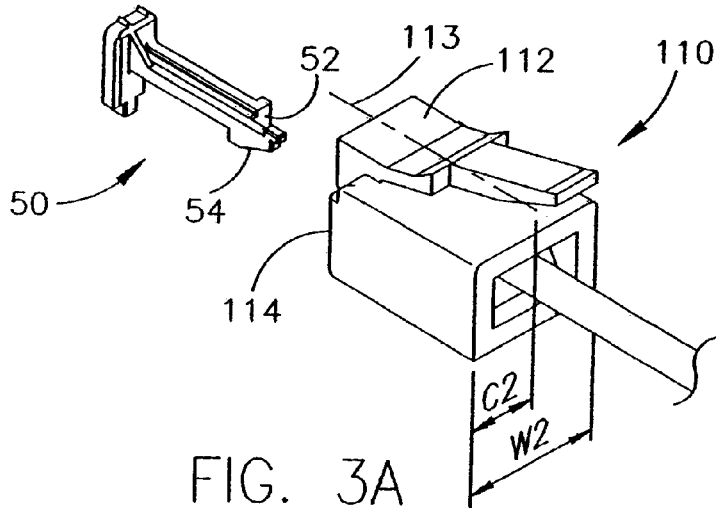
FIGS. 3*a*–3*c* show the operation of the stop surface when an undersized second plug is inserted into the plug-receiving cavity of a receptacle housing incorporating a single cantilevered flexible arm.
Figure 3B:
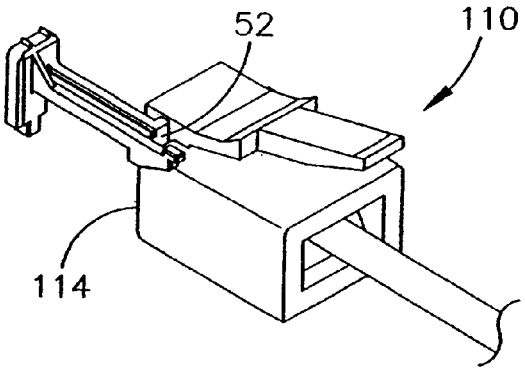
Figure 3C:
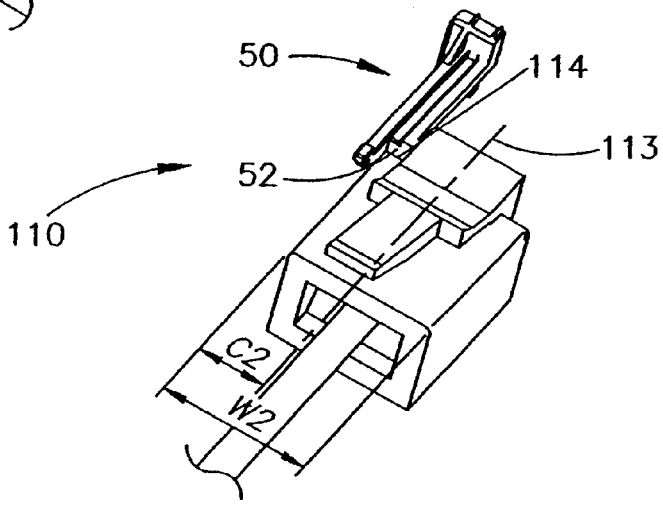
Figure 4A:
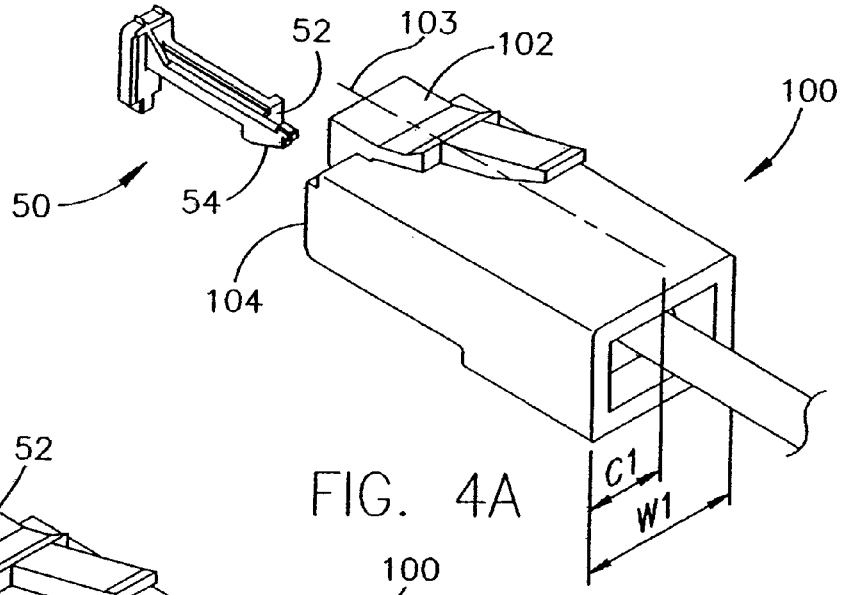
FIGS. 4*a*–4*c* show the operation of the sliding surface when a first plug is inserted into the plug-receiving cavity of a receptacle housing incorporating a single cantilevered flexible arm.
Figure 4B:
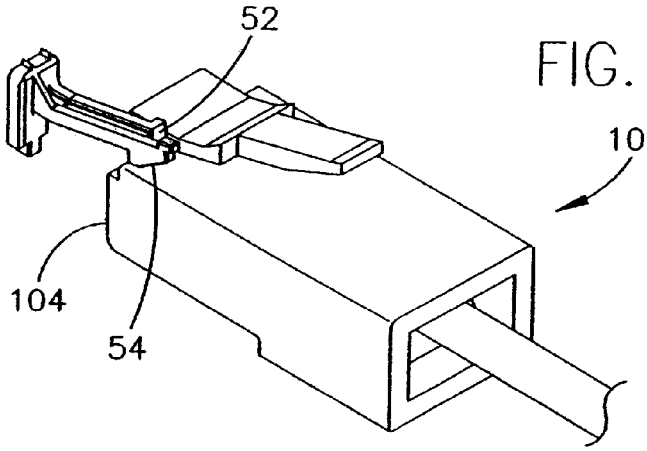
Figure 4C:
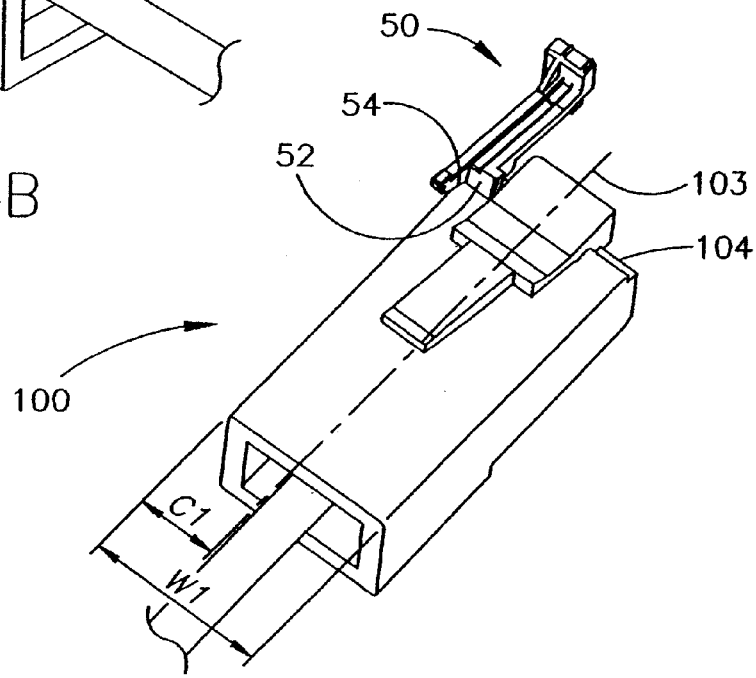

As an example of the operation of the preferred embodiment, FIGS. 3 and 4 illustrate how first stop surface 52 incorporated into first cantilever arm 50 will prevent relatively narrow second plug 110 from being fully inserted into a receptacle designed to mate with a relatively wider first plug 100, while allowing first plug 100 to be fully inserted.

In the example shown, undersized second plug 110 is embodied in a 6-circuit plug and first plug 100 is embodied in an 8-circuit plug. First cantilever arm 50 is shown as it projects from rear wall 22 of receptacle housing 12 into cavity 26. The surrounding structure of receptacle housing 12 has been omitted from these views so that the operation of first cantilever arm 50 can be clearly seen. The receptacle housing into which the plug is to be inserted is a 8-circuit housing, designed to mate with an 8-circuit plug connector.

Referring once more to FIG. 2 and as stated above, first sliding surface 54 is located at a beginning distance X from centerline 31 of polarizing slot 29, and first stop surface 52 is located at a beginning distance Y, but extends no further than distance X from the centerline 31 of polarization slot 29. The stop surface 52 is located on first cantilever arm 50 between distances X and Y so as to ensure contact between stop surface 52 and leading edge 114 of undersized second plug 110 when the second plug 110 is inserted into cavity 26. The dimension C2 of the leading edge of second plug 110 is greater than dimension Y but less than dimension X. The sliding surface 54 is located on cantilevered flexible arm 50 at a distance beginning at X and extends an additional amount beyond distance X so as to ensure contact between the first sliding surface 54 and the leading edge 104 of the first plug 100 when the first plug 100 is inserted into cavity 26. Distance X is less than dimension C1 of the first plug 100.

FIG. 3 shows the undersized second plug connector 110 prior to insertion into the plug-receiving cavity. FIG. 3 shows the second plug connector 110 partially inserted into the plug-receiving cavity. As seen in FIG. 3*b*, due to the location of first stop surface 52 with respect to the receptacle housing centerline, leading edge 114 of undersized second plug 110 will contact first stop surface 52 incorporated into cantilever arm 50 as the 6-circuit second plug is inserted into the plug-receiving cavity of the 8-circuit receptacle housing, preventing further insertion of the 6-circuit circuit second plug into the receptacle housing. FIG. 3*c* is a different view of FIG. 3*b* which better shows the stop surface 52 contacting the leading edge 114 of plug 110 while the sliding surface 54 extends laterally beyond the leading edge 114.

FIG. 4*a* shows the 8-circuit first plug 100 prior to insertion into cavity 26. FIG. 4*b* shows the first plug 100 partially inserted into the plug-receiving cavity. Due to its relatively greater width, as the 8-circuit first plug 100 is inserted into the plug receiving cavity of the 8-circuit receptacle housing, leading edge 104 of 8-circuit first plug 100 will contact sliding surface 54 of cantilever arm 50 rather than first stop surface 52 since dimension C1 is greater than distance X. The sliding contact between first sliding surface 54 and leading edge 104 results in movement of first sliding surface 54 relative to the leading edge 104. This movement causes cantilever arm 50 to bend upward, producing a corresponding movement of first stop surface 52, whereby first stop surface 52 is moved out of the insertion path of leading edge 104. This allows the first plug 100 to pass under first stop surface 52 and to be fully inserted into the plug-receiving cavity.

DETAILED DESCRIPTION OF THE ALTERNATIVE EMBODIMENTS

Figure 5A:
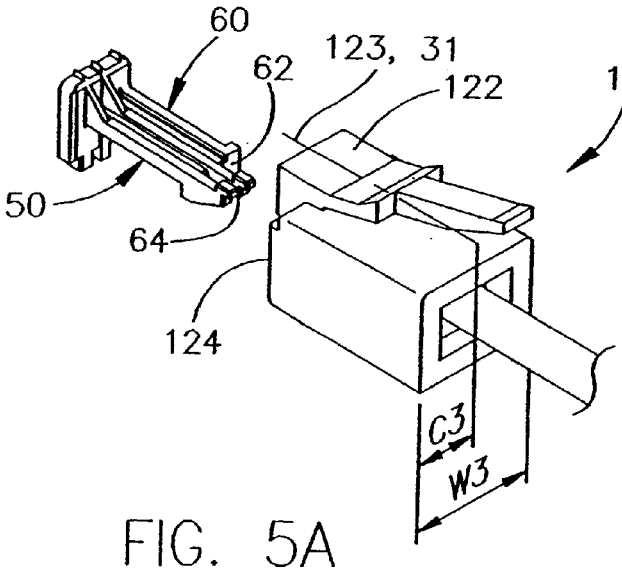
FIGS. 5*a*–5*d* alternative embodiment) show the operation of a stop surface on a second cantilevered flexible arm when an undersized third plug is inserted into the plug-receiving cavity of a receptacle housing incorporating two adjacent cantilevered flexible arms.
Figure 5B:
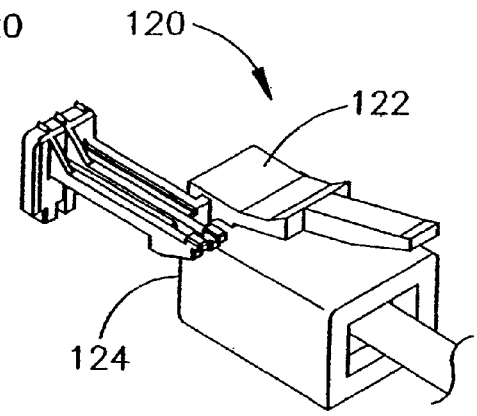
Figure 5C:
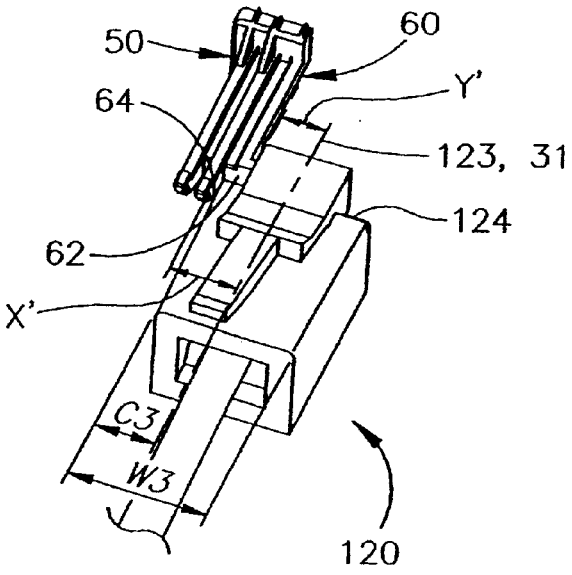
Figure 5D:
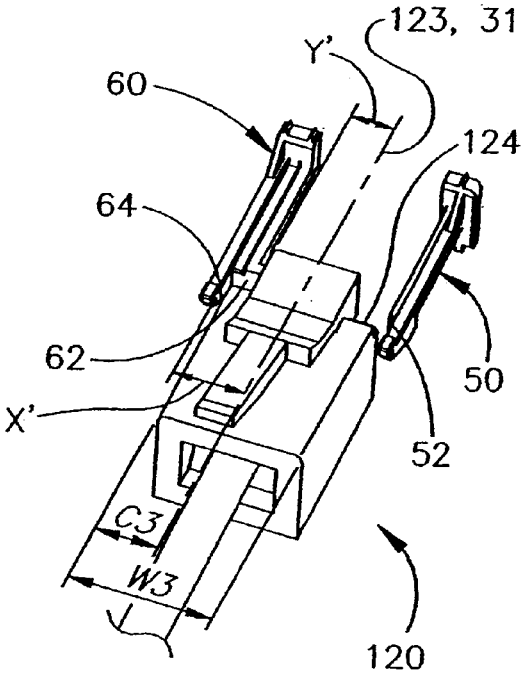
Figure 6A:
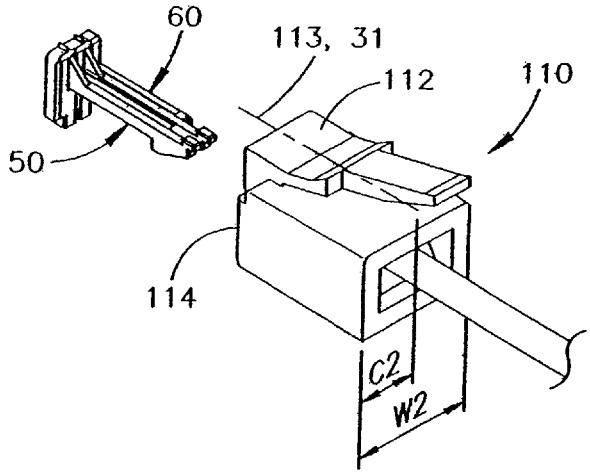
FIGS. 6*a*–6*b* (alternative embodiment) show the operation of a sliding surface on a second cantilevered flexible arm and the stop surface on the first cantilevered arm when the undersized second plug is inserted into the plug-receiving cavity of a receptacle housing incorporating two adjacent cantilevered flexible arms.
Figure 6B:
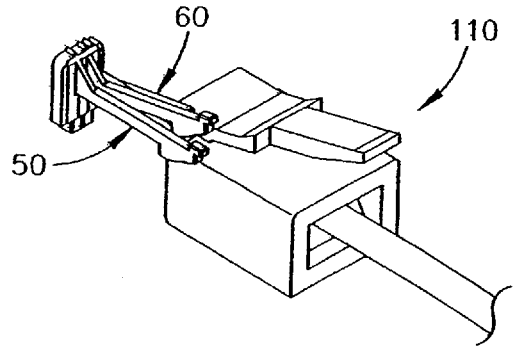
Figure 7A:
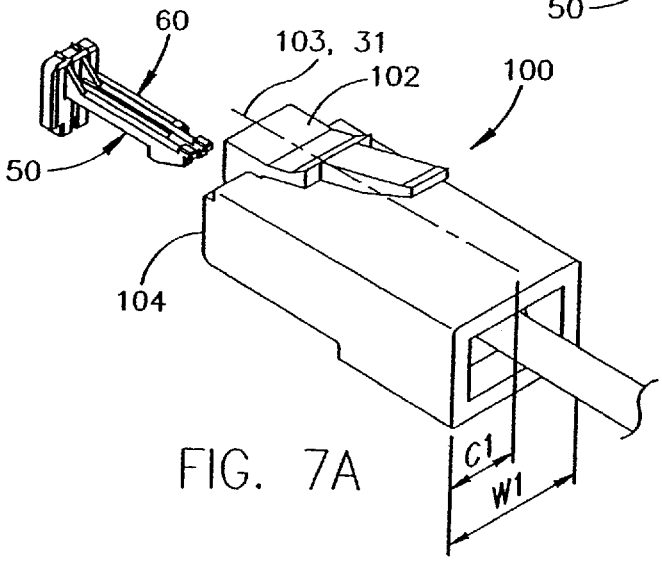
FIGS. 7*a*–7*b* (alternative embodiment) show the operation of a sliding surface on both first and second cantilevered flexible arms when the plug is inserted into the plug-receiving cavity of a receptacle housing incorporating two adjacent cantilevered flexible arms.
Figure 7B:
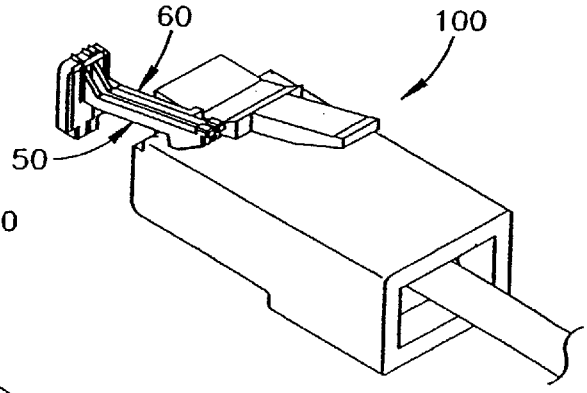

FIGS. 5–7 illustrate an alternative embodiment of the invention, in which a second flexible member is incorporated into the receptacle housing proximate the first flexible member. In FIGS. 5–7, the second flexible member is shown in the form of a second cantilever arm 60. Second cantilever arm 60 has the same basic structure as first cantilever arm 50, incorporating a second stop surface 62 positioned within cavity 26 so as to prevent full insertion of an undersized third plug 120 into plug-receiving cavity 26, and a second sliding surface 64 also positioned within cavity 26. Second sliding surface 64 is located at a beginning distance X' from a centerline 31 of polarizing slot 29, and second stop surface 62 is located at a beginning distance Y' but extends no farther than a distance X' from the centerline 31 of polarizing slot 29. The stop surface 62 is located on second cantilever arm 60 between distances X' and Y' so as to ensure contact between stop surface 62 and leading edge 124 of undersized third plug 120.

Undersized third plug 120 has a leading edge 124, depending latch arm 122 and a third dimension W3 extending along an axis perpendicular to the plug insertion direction. C3 is a dimension extending along the width of the plug from the center line 123 of latch arm key 122 to an edge of leading surface 124. Dimensions W3 and C3 are also less than dimensions W1 and C1 respectively since the width of third plug 120 is less than the width of first plug 100.

Operation of the second cantilever arm 60 is similar to that of first cantilever arm 50. As shown in FIGS. 5*a*, 5*b* and 5*c*, undersized third plug 120 is embodied in a 4-circuit plug. First cantilever arm 50 and second cantilever arm 60 are shown as they project from rear wall 22 of receptacle housing 12 into cavity 26 (not shown). The receptacle housing into which the plug is to be inserted is a 8-circuit housing, designed to mate with an 8-circuit plug connector.

In the event 6-circuit plug 110 is inserted into a receptacle housing incorporating the two adjacent flexible cantilever arms 50, 60, the leading edge 114 of 6-circuit second plug 110 will contact sliding surface 64 of second cantilever arm 60 causing the stop surface 64 of the second cantilever arm 60 to be raised out of engagement with the leading surface 114 of second plug 110. Thus, second stop surface 62 will not prevent full insertion of second plug 110. However, the first stop surface 52 incorporated into first cantilever arm 50 is positioned to contact leading edge 114 of 6-circuit plug 110 as described above, preventing further insertion of second plug 110. Thus, the incorporation of two adjacent cantilever arms in the receptacle housing will prevent full insertion of two different undersized plugs.

In a second alternative embodiment, not shown, the second cantilever arm may be located on a side of the polarizing slot centerline 31 opposite the first cantilever arm. In this embodiment, the distances X' and Y' of second stop surface 62 from the slot centerline 31 would still be chosen so as to ensure contact between second stop surface 62 and a leading edge 124 of 4-circuit plug 120 when 4-circuit plug 120 is inserted into cavity 26. Also, the distance X' of second sliding surface 64 from the slot centerline 31 would still be chosen so as to ensure contact between second sliding surface 64 and leading edge 104 of 8-circuit plug 100 when 8-circuit plug 100 is inserted into cavity 26.

In a third alternative embodiment, not shown, full insertion of both the 4-circuit plug 120 and the 6-circuit plug 110 may be prevented in a receptacle housing incorporating only a first cantilever arm 50 with an enlarged stop surface 52 so that the enlarged stop surface can contact the leading edge 114 or 124 of either plug 110 or 120, respectively, while the leading edge 104 will contact the sliding surface 54.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A receptacle connector for selectively limiting insertion of a plug into a plug receiving cavity comprising:

a housing having said plug receiving cavity extending into the housing from a front wall with a polarizing slot for receiving a first and second plug in a plug insertion direction and with a rear wall, the first and second plugs each having a leading surface and a polarizing key, said polarizing key slidably insertable into the polarizing slot, the slot and the polarizing key of each of the first and second plug having a center line in line with one another when one key is inserted into the slot, the leading surface of the first plug having a first plug dimension from the center line of the first plug polarizing key to an edge of the leading surface, the leading surface of the second plug having a second plug dimension from the center line of the second plug polarizing key to an edge of the leading surface of the second plug, the second plug dimension being less than the first plug dimension; and a flexible cantilevered arm, extending from said rear wall, formed integral with the housing and having a distal free end projecting into the plug receiving cavity, the flexible cantilevered arm having a stop surface and a sliding surface, the stop surface positioned within the plug receiving cavity for contacting the leading surface of the second plug when the second plug is inserted into the plug receiving cavity, whereby further insertion of the second plug into the cavity is stopped and the sliding surface, beginning at the distal free end of the flexible cantilevered arm which free end is located adjacent the front wall of the housing, is positioned within the plug receiving cavity a lateral distance from the centerline of the polarizing slot so that the sliding surface will contact the leading surface of the first plug at a predetermined distance from the center line of the polarizing key, the predetermined distance being less than the first plug dimension and greater than the second plug dimension, to slidably contact the leading surface of the first plug as the first plug is inserted into the plug receiving cavity, causing the flexible cantilevered arm to bend such that the stop surface is moved out of engagement with the leading surface of the first plug, thereby allowing complete insertion of the first plug into the plug receiving cavity.

2. The receptacle connector of claim 1 wherein said plug receiving cavity in said housing is further designed to also receive a third plug in said plug insertion direction, the third plug having a leading surface and a polarizing key slidably insertable into the polarizing slot, the polarizing key of the third plug having a center line in line with the center line of the slot, the leading surface of the third plug having a third plug dimension from the center line of the third plug polarizing key to an edge of the leading surface, the third plug dimension being less than both the first plug dimension and the second plug dimension, and a second flexible cantilevered arm projecting into the plug receiving cavity, the second flexible cantilevered arm having a second stop surface positioned within the plug receiving cavity for contacting the leading surface of the third plug when the third plug is inserted into the plug-receiving cavity, whereby further insertion of the third plug into the cavity is blocked.

3. The receptacle housing of claim 2 wherein the second stop surface is moveable in response to the insertion of the first plug.

4. The receptacle connector of claim 2 wherein the second flexible cantilevered arm has a sliding surface positioned within the plug receiving cavity a lateral distance from the centerline of the polarizing slot so that the sliding surface of the second flexible cantilevered arm will contact the leading surface of the first plug at a predetermined distance from the center line of the polarizing key, the predetermined distance being less than the first plug dimension and greater than the second plug dimension, to slidably contact the leading surface of the first plug as the first plug is inserted into the plug-receiving cavity causing the flexible member to move such that the stop surface is moved out of engagement with the leading surface of the first plug, thereby allowing complete insertion of the first plug into the plug receiving cavity, and wherein the sliding surface of the second flexible cantilevered arm is positioned within the plug receiving cavity a lateral distance from the center line of the polarizing slot so that the sliding surface of the second flexible cantilevered arm will contact the leading surface of at least the first plug at a distance from the centerline of the polarizing key which is less than the first plug dimension and greater than the third plug dimension.

5. The receptacle connector of claim 4 wherein the flexible cantilevered arm and second flexible cantilevered arm are located on opposite sides of the centerline of the polarizing slot.

6. The receptacle connector of claim 4 wherein the flexible cantilevered arm and the second flexible cantilevered arm both extend generally parallel to the plug insertion direction.

7. A receptacle connector for selectively limiting insertion of a plug into a plug receiving cavity, comprising:

a housing having said plug receiving cavity extending into the housing from a front wall with a polarizing slot for receiving a first, second or third plug in a plug insertion direction and with a rear wall, the first, second and third plugs each having a leading surface and a polarizing key, said polarizing key slidably insertable into the polarizing slot, the polarizing slot and polarizing keys of each of the first, second and third plugs each having a center line in line with one another when the key is inserted into the slot, the leading surface of the first plug having a first plug dimension from the center line of the first plug polarizing key to an edge of the first plug leading surface, the leading surfaces of the second and third plugs having respective plug dimensions from the center lines of the second and third plug polarizing keys to edges of the leading surface of the second and third plugs being less than the first plug dimension; and a first flexible cantilevered arm, extending from said rear wall, formed integral with the housing and having a distal free end projecting into the plug receiving cavity, the first flexible cantilevered arm having a stop surface and a sliding surface, the stop surface positioned within the plug receiving cavity for contacting the leading surface of the second plug when the second plug is inserted into the plug receiving cavity, whereby further insertion of the second plug into the cavity is stopped and the sliding surface, beginning at the distal free end of the first flexible cantilevered arm which free end is located adjacent the front wall of the housing, is positioned within the plug receiving cavity a lateral distance from the centerline of the polarizing slot so that the sliding surface will contact the leading surface of the first plug at a predetermined distance from the center line of the polarizing key, the predetermined distance being less than the first plug dimension and greater than the second plug dimension, to slidably contact the leading surface of the first plug as the first plug is inserted into the plug receiving cavity, causing the flexible cantilevered arm to bend such that the stop surface is moved out of engagement with the leading surface of the first plug, thereby allowing complete insertion of the first plug into the plug receiving cavity;

a second flexible cantilevered arm, extending from said rear wall, formed integral with the housing and having a distal free end projecting into the plug receiving cavity, the second flexible cantilevered arm having a stop surface and a sliding surface, the stop surface positioned within the plug receiving cavity contacting the leading surface of the third plug when the third plug is inserted into the plug receiving cavity, whereby further insertion of the third plug into the cavity is stopped.

8. The receptacle connector of claim 7 wherein the second flexible cantilevered arm has a sliding surface positioned within the plug receiving cavity a lateral distance from the centerline of the polarizing slot so that the sliding surface will contact the leading surface of the first plug at a distance from the center line of the polarizing key, which is less than the first plug dimension and greater than each of the second and third plug dimensions, to slidably contact the leading surface of the first plug as the first plug is inserted into the plug receiving cavity, causing the second flexible cantilevered aim to move such that the stop surface is located out of engagement with the leading surface of the first plug thereby allowing complete insertion of the first plug into the plug receiving cavity.

* * * * *